United States Patent [19]

Tsukamoto et al.

[11] Patent Number: 5,069,760

[45] Date of Patent: Dec. 3, 1991

[54] APPARATUS AND METHOD FOR SURFACE TREATMENT OF WORKPIECES

[75] Inventors: Hirokazu Tsukamoto; Seishi Watanabe, both of Iwata, Japan

[73] Assignee: Yamaha Hatsudoki Kabushiki Kaisha, Shizuoka, Japan

[21] Appl. No.: 542,094

[22] Filed: Jun. 22, 1990

[30] Foreign Application Priority Data

Jun. 30, 1989 [JP] Japan ..... 1-167137

[51] Int. Cl.[5] ..... C25D 7/04; C25D 17/28; B05C 3/00

[52] U.S. Cl. ..... 205/80; 204/198; 118/423; 205/131; 205/205

[58] Field of Search ..... 204/198, 200, 203, 14.1, 204/26, 29; 118/423

[56] References Cited

U.S. PATENT DOCUMENTS

| | | | |
|---|---|---|---|
| 2,175,788 | 10/1939 | Todd | 204/203 X |
| 2,848,405 | 8/1958 | Lisowski et al. | 204/203 |
| 2,958,331 | 11/1960 | Borodin | 204/198 X |
| 3,106,927 | 10/1963 | Madwed | 204/198 X |
| 4,028,211 | 6/1977 | Hirakawa et al. | 204/198 X |
| 4,318,793 | 3/1982 | Ando et al. | 204/198 |

FOREIGN PATENT DOCUMENTS

| | | | |
|---|---|---|---|
| 1145457 | 3/1963 | Fed. Rep. of Germany | 204/200 |

*Primary Examiner*—Donald R. Valentine
*Attorney, Agent, or Firm*—Bacon & Thomas

[57] ABSTRACT

A chemical treating system includes a main row or line of equally spaced, equal length chemical treatment workstations for sequentially treating a workpiece such as the cylinder bore of an internal combustion engine cylinder. Additional longer chemical treatment workstations are located transversely of the main row of workstations so that larger workstations can be included in the chemical treatment system without increasing the total length of the main row of workstations. By locating the longer workstations transversely of the main row, equal distances between the main row of workstations can be maintained by using work transfer devices that move the workpieces longitudinally along the main row and transversely to the additional chemical treatment workstations in a sequential process. At the transversely located workstation, an airblower is provided to remove residual chemical treatment solution from the workpieces before they are returned to the main line of workstations. Where the workstation constitutes an electrolytic plating system for the workpiece surfaces, an electrically conductive conduit is included for conveying the plating solution so that the conduit may be utilized as an electrode during the plating operation.

22 Claims, 4 Drawing Sheets

APPARATUS AND METHOD FOR SURFACE TREATMENT OF WORKPIECES

BACKGROUND OF THE INVENTION

1. Field of the Invention

This invention relates to a chemical surface treatment system for workpieces, in particular a system for sequentially subjecting workpieces to a series of associated liquid chemical baths for treating a surface or surfaces of the workpiece.

2. Discussion of Related Art

It is known in the prior art to provide a workpiece surface chemical treatment system comprising a row or line of associated workstations for successively treating a workpiece that is moved from station to station to chemically treat the entire workpiece or selected surfaces thereof. For example, a high speed electroplating system is known wherein workpieces are automatically transferred from one station to the next for the purpose of degreasing the workpiece, subjecting the workpiece to alkali and acid baths, anodizing the workpiece and ultimately electroplating the workpiece in a conventional manner. It is also known that such workstations can be arranged to treat interior surfaces of a chamber or a hollow portion of a workpiece at a high rate of speed.

To accommodate the automated work transfer system, and to simplify the advancement of the workpiece along the row of workstations, for example in a high speed chemical plating system, it is highly desirable to space the workstations at substantially equal increments of distance to the extent possible, for obvious reasons. On the other hand, it is not always practical or possible to space the workstations at equal increments, particularly in those situations where one or more of the workstations includes auxiliary equipment that requires it to be greater in length than other or adjacent workstations in the system. This is particularly the case in a situation where the workpiece comprises an object having a hollow chamber with ports that must be plugged during chemical treatment of the interior surfaces of the chamber with a circulating liquid solution. An example of such a workpiece would be an engine cylinder having sparkplug, intake and exhaust ports that must be plugged during chemical treatment of the cylinder bore. Typically, in a high speed plating system, the system for plugging the ports in the workpiece entails the use of automatically actuated plugs for the ports and auxiliary actuating fluid motors or cylinders for the plugs that require additional workstation length to accommodate the motor cylinders or other equipment required at the workstation.

The problem, therefore, is to provide a system of the type mentioned wherein workpieces can be automatically sequentially moved equal increments of length along the row of workpiece treating workstations while accommodating individual workstations that have a greater length than the remaining workstations along the main row or line. Obvious benefits would flow from the ability to move the workpieces at equal increments from station to station, including simplification of the work transfer control system and avoidance of increasing the total length of the workpiece processing line.

An incidental problem associated with chemical treatment of workpieces using liquid chemical solutions that are corrosive or otherwise detrimental to the integrity of the workstation hardware is the fact that leakage or drippage of chemical treating solution along the row of workstations as the workpieces are transferred from station to station causes corrosion of the workstation equipment. It is desirable to remove residual liquid chemical solution from the workpieces immediately after treatment before they are advanced along the treatment line.

BRIEF SUMMARY OF THE INVENTION

The present invention solves the aforesaid problems by providing a workpiece chemical treatment system wherein some of the workstations of the system are located transversely adjacent the regular line of workstations so that the workpiece can be advanced longitudinally along the line, transversely (or laterally) of the line to the adjacent workstations, and then back to the main line for continued longitudinal movement through each sequential chemical processing step. The transversely adjacent workstations may include auxiliary equipment that results in a greater overall length of the lateral workstation than the stations along the main processing line, yet the total system is arranged such that the longitudinal distance between all of the workstations is substantially the same so that workpiece movement is simplified and the total length of the main workline is not substantially increased.

Thus, for example, chemical treatment of the cylinder bore of an integrated internal combustion cylinder and head element is facilitated, since the additional length required for the cylinder port plugging devices can be accommodated off the main line while the longitudinal spacing between all the workstations is maintained substantially equal.

Accordingly, the invention provides a chemical treating system comprising adjacent longitudinally extending chemical treating workstations arranged in a row or line, longitudinal work transfer means moving the workpieces at least along the row between the workstations, at least one additional chemical treating workstation located adjacent and transversely of the row of workstations at a longitudinal position located between two longitudinally separated workstations in the rows, and a transverse work transfer means for moving the workpieces transversely of the row of workstations to the additional workstation and back to the row of workstations for continued movement along the row by the longitudinal work transfer means.

The row of workstations are all spaced at substantially equal longitudinal increments along the chemical treatment line and the additional chemical treating workstations located laterally of the main line may accommodate auxiliary equipment making the individual workstation longer than the other workstations in the main line, so long as the spacing between the additional (lateral) workstations is sufficient to accommodate the auxiliary equipment.

The invention also contemplates an air blowing system for removing residual chemical liquid solution used to treat the workpiece at the auxiliary workstations before the workpiece is returned to the main treatment line.

The invention also contemplates the use of a conductive conduit for transporting plating solution in an electroplating system for workpieces such as cylinder bores of internal combustion engines, so that the conduit is used to carry an electrical charge used during the electroplating process.

The present invention also contemplates a chemical surface treating system for cylinder bores of internal combustion engines wherein different sets of plugs for the ports of the cylinder bores can be provided for automatically closing the ports during the chemical treating process. Differently configured sets of plugs and their associated actuators can be mounted upon interchangeable jig fixtures that can be rapidly positioned at the workstations for accommodating different cylinder port arrangements of different workpieces.

BRIEF DESCRIPTION OF THE DRAWINGS

With reference to the appended drawings, which depict a preferred embodiment of the invention.

DETAILED DESCRIPTION OF PREFERRED EMBODIMENT

Figure 1:
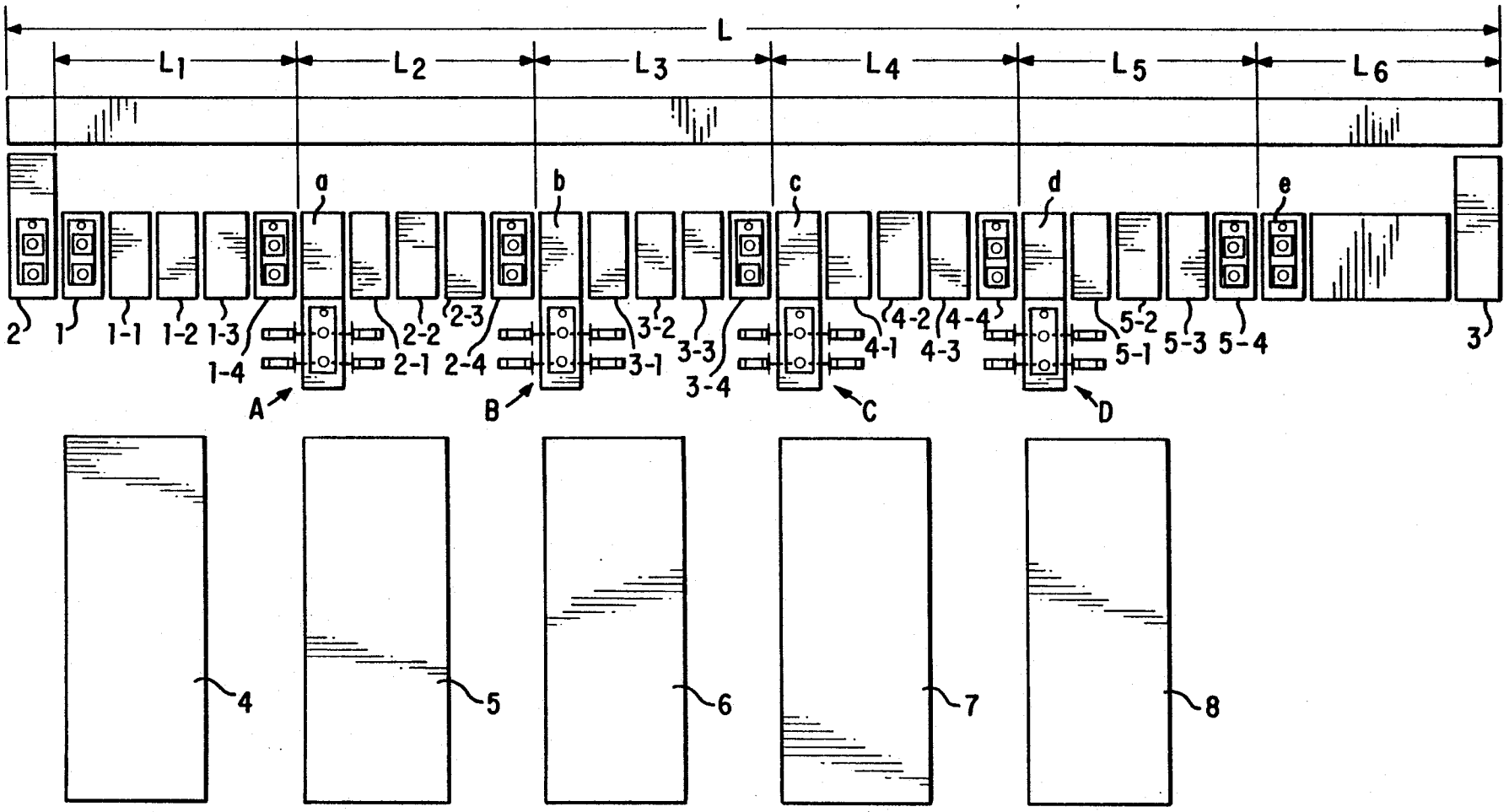
FIG. 1 schematically illustrates a plan view of a workpiece chemical surface treating system embodying this invention.

With reference to FIG. 1, a workpiece chemical surface treatment line is schematically illustrated. In this example, the line is intended to progressively and sequentially treat and internal combustion engine cylinder workpiece for eventual chrome plating of the cylinder bore surfaces (see FIG. 4). Accordingly, the workstations of the main line include a degreasing workstation 1, an alkali bath treatment workstation A, an acid bath treatment workstation B, an anodizing workstation C and an electroplating workstation D. Also included are an input station 2, workpiece transfer stations, a, b, c and d; drying station e; water wash tank workstations 1-1 through 1-4; 2-1 through 2-4; 3-1 through 3-4; 4-1 through 4-4 and 5-1 through 5-4. A work removal workstation 3 is provided at the right end of the work treatment system as illustrated at 3. The workstations 1, 2, a–e, and 1-1 through 5-4 are arranged in a longitudinal row or line, which may extend in a straight or curved direction. Storage tanks 4–8 respectively are provided adjacent the line for storing degreasing, alkali treatment, acid treatment anodizing and plating solutions used in the chemical treating system just described. However, the alkali treatment, acid treating, anodizing treatment and electroplating workstations A–D are located transversely of an adjacent the main line of workpiece treating stations, although the incremental distances $L_1$ through $L_6$ between the workstations A-B-C-D is substantially equal to provide a total length L for the main line of workprocessing stations. As illustrated in the preferred embodiment, the longitudinal distance between each of the workstations in the main line and the transversely adjacent stations A–D is substantially equal.

It will be noted that each of the workstations A, B, C and D has a total length as measured longitudinally along the distance L that is greater than the workstations in the main row. To avoid increasing the total distance L and to maintain the equal distances $L_1$ through $L_5$ between workstations, the workstations A–D are located transversely of the main row of workstations so that the increased length of each of the transversely located workstations can be accommodated. Moreover, to facilitate transfer of workpieces moving along the main line both longitudinally along the main line and transversely to the additional workstations A–D, work transfer stations a, b, c and d are provided whereat the workpieces may be positioned for transverse movement to and from the laterally located workstations A–D.

Figure 2:
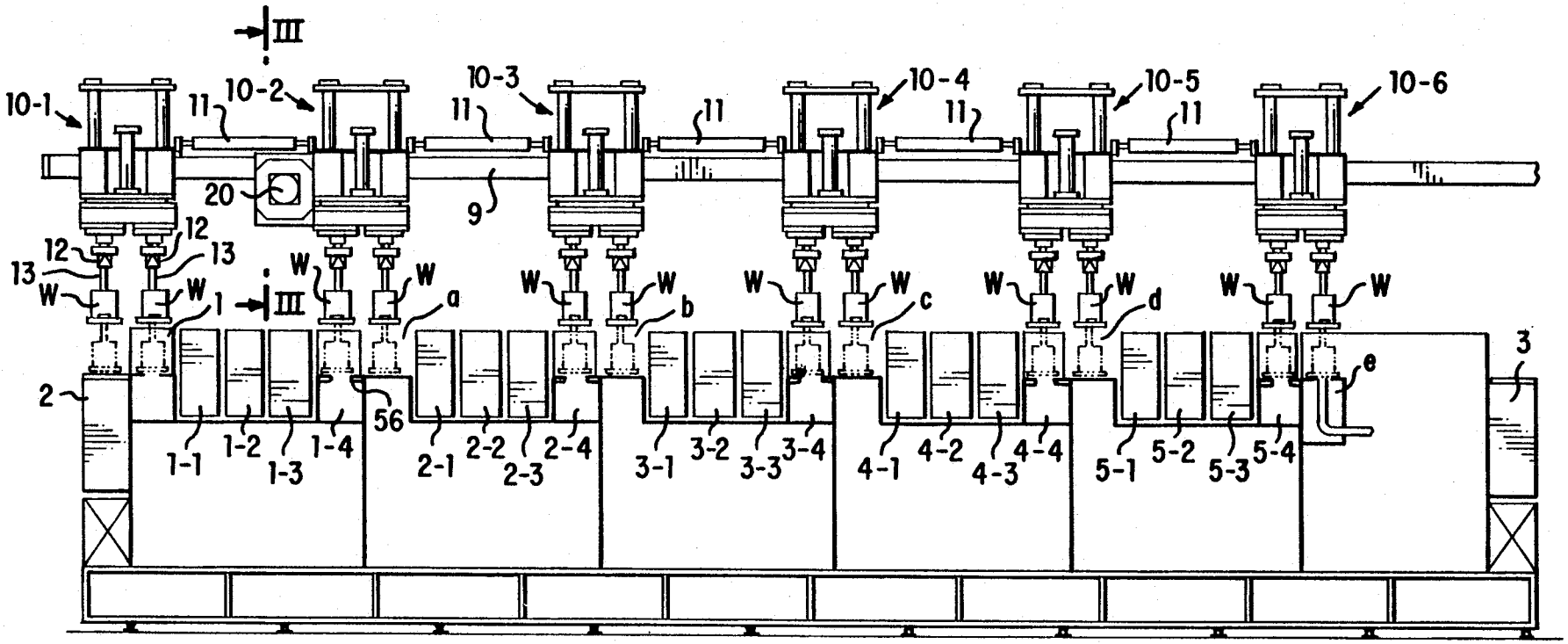
FIG. 2 is a side elevation view of the treatment system illustrated in FIG. 1.

As shown in FIG. 2, workpiece conveyors 10-1 through 10-6 connected by connector rods 11 are mounted on a support beam 9 for simultaneous actuation by a single motor 20 associated with work transfer device 10-2. Accordingly, upon actuation of motor 20, all the work transfer devices 10-1 through 10-6 move simultaneously along beam 9 to advance workpieces W between each of the workstations in the main row. Each work transfer device moves a set of workpieces W over a total length corresponding to the distance between adjacent transfer devices 10-1 to 10-2, etc.

Figure 3:
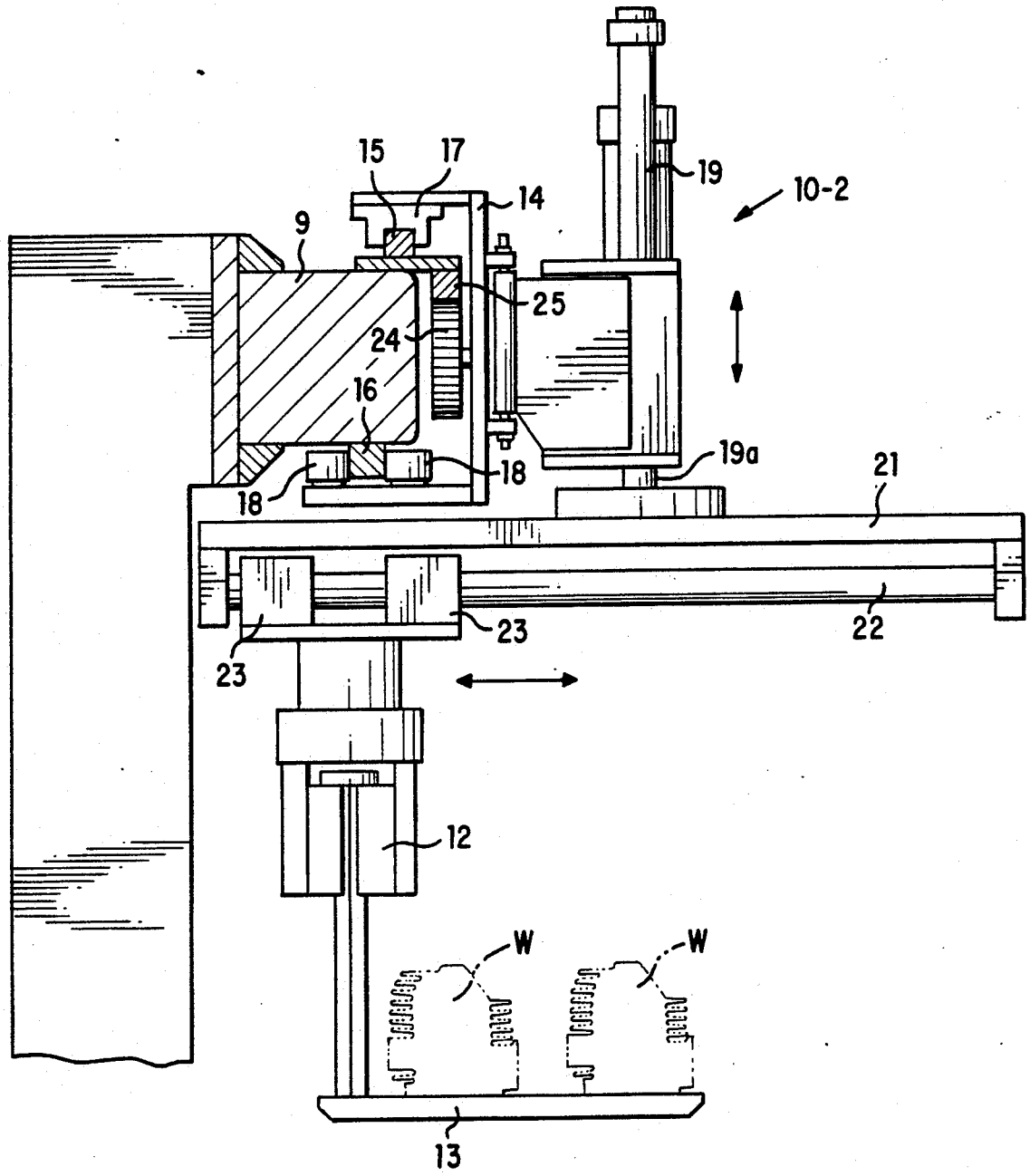
FIG. 3 is a section view taken substantially along line III—III of FIG. 2 showing the work transfer system and its associated support structure.

As shown in FIG. 3, a typical work transfer device 10-2 is illustrated as viewed along line III—III shown in FIG. 2. Transfer device 10-2 is supported by beam 9 for longitudinal movement therealong by U-shaped frame 14 that cooperates with longitudinal rails 15, 16 through a guide 17 and guide rollers 18. Rotation of motor 20 (FIG. 2) rotates pinion gear 24 along rack 25 so that the entire work transfer device 10-2 (and the other work transfer devices via rods 11) is propelled along rail 9 upon actuation of motor 20. A transverse frame 21 is mounted for vertical linear movement by means of actuator cylinder 19 and cylinder shaft **19*a* relative to beam 9. A transverse threaded drive shaft 22 carries threaded nuts 23 so that, when workpiece conveying jig 13 is engaged by chuck 12 and rod 22 is rotated by an appropriate actuator, the nuts 23 and jig 13 are moved transversely along the guide rod 22. The actuating motor for rotating the guide rod 22 is not illustrated, since it does not form a part of the invention, and any suitable motor and associated driving mechanism may be used to effect rotation of the guide rod 22. Indeed, any suitable drive mechanism could be used to move the chuck 12 transversely of beam 9**.

Thus, the jig 13 carrying workpieces W may be moved longitudinally parallel to rail 9 and transversely perpendicular to the rail 9 by means of the work transfer device 10-2. All of the movements of the work transfer device as well as the jig 13 may be remotely instigated and controlled in a manner well known in automated high speed workpiece treating systems of the type exemplified here.

Figure 4:
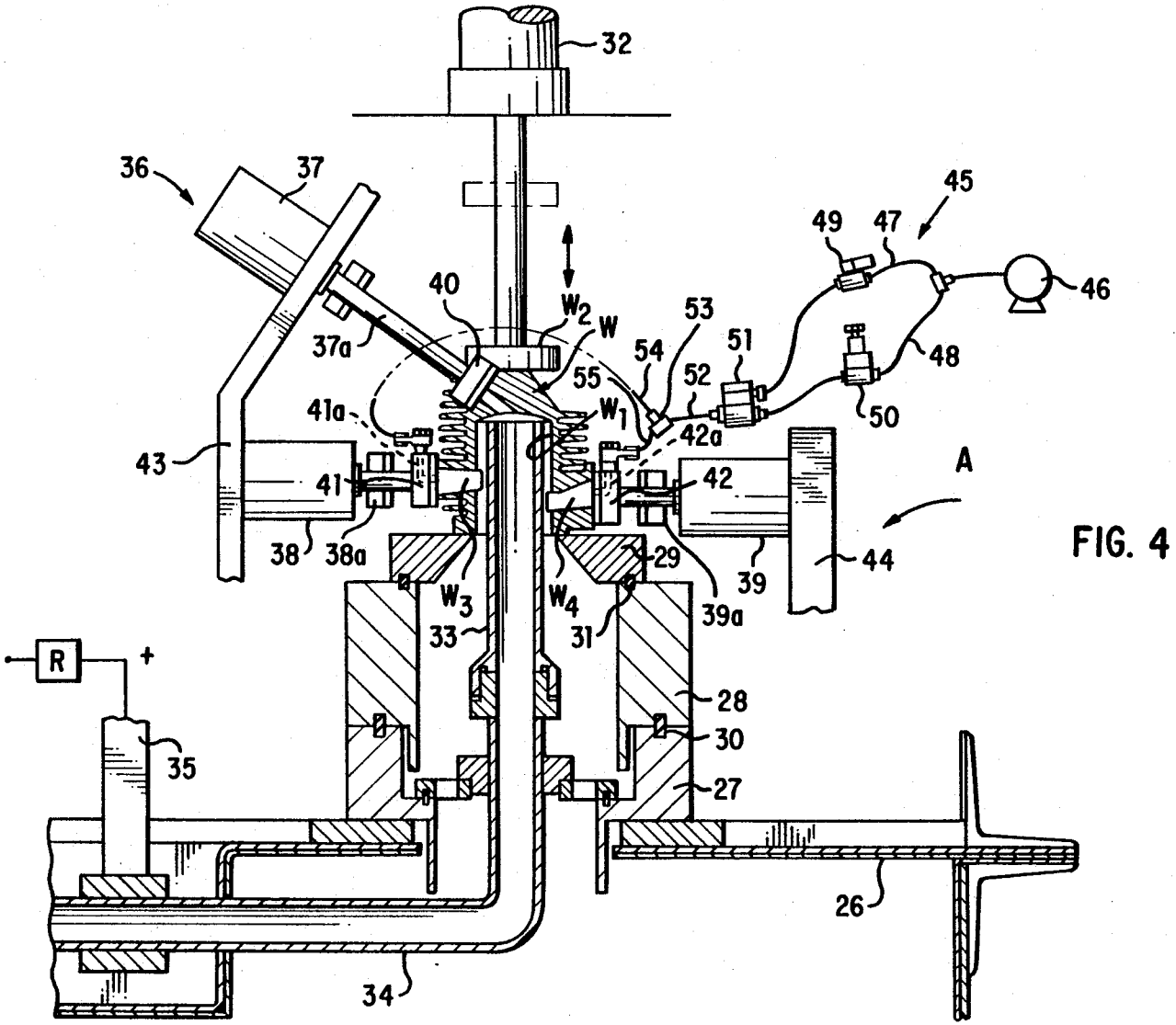
FIG. 4 is an elevation cross section view of an electroplating workstation including a cylinder workpiece in position at the workstation with the ports plugged and the electrically conductive conduit for electrolyte in position within the cylinder bore.

Referring now to FIG. 4, the electroplating workstation D is illustrated with an internal combustion engine cylinder workpiece W in position for electroplating of the internal cylinder bore surfaces $W_1$. A hollow, two stage support block 27, 28 is stacked above a plating solution tank 26, with a jig 29 placed on top of the support block 28. Seals 30, 31 between blocks 27, 28 and jig 29 prevent leakage of plating solution between the joints of the block and the jig. A pair of workpieces W (only one being visible in this view) have been pressed against the jig 29 by motor cylinder 32 and its associated movable rod. The cylinder bore $W_1$ surrounds a central electroplating solution conduit 33 that extends up from the tank 26 through blocks 27, 28 and jig 29. The conduit 33 is in communication with another section of conduit 34, with both conduits 33, 34 being electrically conductive. The interior of the conduits may be rubber-lined, for example, while the conduit itself is preferably made of copper or other good conductor. An electrical bus bar 35 which may be made of copper sheet is conductively connected to conduit 34 and is electrically connected to a source of electrical current including a rectifier R. Upon energization of the bus bar 35, the conduits 33, 34 will conduct a charge to the interior of the cylinder bores $W_1$, so that when electroplating solution flows through the conduits 33, 34 electroplating of the cylinder bores will be carried out in accordance with known procedures. The workpiece W, of course, would be appropriately grounded to enable flow of electrical current during the electroplating process.

It will noted that the workpiece W includes ports $W_2$, $W_3$, $W_4$ in communication with the exterior of the workpiece. Typically, these would constitute spark plug, exhaust and intake ports respectively for the cylinder bore $W_1$. During electroplating and other chemical surface treatments involving application of liquid solution to the cylinder bore, it is necessary to plug the ports in a high speed, automated fashion. For this purpose, remotely controlled actuator cylinders 37, 38 and 39 with associated cylinders 37*a*, 38*a* and 39*a* are provided so that port plugs at the ends of each of the cylinder rods 37*a*, 38*a* and 39*a* may be rapidly advanced to seal the ports $W_2$, $W_3$ and $W_4$ during a treatment process occurring at the respective workstation where the cylinder motors are provided. Plugs 40, 41 and 42 mounted at the ends of the cylinder rods 37*a*, 38*b* and 39*a*, respectively, press against the ports $W_2$, $W_3$, and $W_4$ to seal them against leakage of chemical solution used to treat the interior surfaces of cylinder bore $W_1$. Different sets of actuating cylinders 37, 38 and 39 may be preassembled upon different jigs 43, 44 that are interchangeably mounted at the respective workstation utilizing the sealing plugs and drive motor cylinders. It is contemplated that different configurations of cylinders and plugs pre-assembled to jigs 43, 44 will be utilized to accommodate different port arrangements provided on different workpieces moving down the surface treatment line. This avoids the need to remove and reassemble individual plug and motor assemblies at the workstations, thereby increasing the efficiency and flexibility of the treating system.

An airblowing system for removing residual chemical treatment solution is also provided at one or more of the workstations A–D. A typical airblowing system is shown at 45 in FIG. 4 and includes air compressor 46, hoses 47, 48 for receiving compressed air from compressor 46, solenoid valve 49, pressure regulator 50 and solenoid valve 51. From valve 51, there extends a hose 52 connected to a tee 53 to provide compressed air to branch hoses 54, 55 in communication with air flow openings 41*a* and 42*a* formed in plugs 41 and 42 at the ends of cylinder rods 38*a* and 39*a*. Thus, under the control of valve 51, compressed air may flow into the interior of the cylinder bores $W_1$ through the plugs 41, 42 via openings 41*a* and 42*a* to remove residual chemical treatment solution from the interior of the cylinder bore upon completion of the chemical treatment process. The compressed air openings are associated with the movable plugs 41, 42 so that the compressed air is placed in communication with the cylinder bore $W_1$ rapidly upon advancement of the plugs 41, 42 against their respective ports in workpiece W.

Considering next the overall operation of the system, the movement of a single workpiece W will be followed in detail.

As seen in FIGS. 1 and 2, an engine cylinder workpiece W has been deposited at work entry unit 2. The work transfer device 10-1 is then actuated to lower jig engaging chuck 12 to engage a jig 13 supporting preferably a pair of workpieces W. The chuck 12, as explained previously has been lowered by actuating cylinder 19 which is also used to raise the chuck 12 for movement to a succeeding workstation. Next, work transfer drive motor 20 is actuated to cause rotation of pinion 24 and movement of the work transfer device 10-2 along rail 9 in a longitudinal direction along the row of workstations in the main line. All of the work transfer devices 10-1 through 10-6 move simultaneously along beam 9 as a unit over a prescribed interval. As seen in FIG. 1, this movement is to the right until the work transfer unit 10-1 is positioned so that the pair of workpieces W is over the degreasing tank 1. The actuating motor 19 is then energized so that the workpieces W descend and are emersed in degreasing tank 1 for a prescribed period of time.

Following degreasing, the workpieces are progressively and sequentially moved through water washtanks 1-1 through 1-4 by workpiece transfer device 10-1. At wash tank 1-4, the transfer device 10-1 releases its jig 13 and leaves it on support platform 56 with workpieces W in the tank 1-4. Upon release of the respective jig 13, the workpiece transfer device 10-1 along with other work transfer devices 10-2 through 10-6 move to the left along beam 9 and stop at the position shown in FIG. 2 (the starting position). Workpieces W in wash tank 1-4 are then picked up and moved by the next succeeding workpiece transfer device 10-2 to the alkali treatment unit A which is located transversely of the main workstation line, as seen in FIG. 1. Movement of the workpieces W is effected by rotation of rod 22 and transverse movement of chuck 12 from the main line to the transversely located workstation A. At workstation A, alkali treatment of the interior surfaces of each cylinder bore $W_1$ takes place, with sealing of the ports of each workpiece being carried out substantially as shown in FIG. 4 as previously described. Upon completion of the alkali treatment, the workpieces W are returned transversely back to the main line by workpiece transfer device 10-2 and then the workpieces are longitudinally moved along the main row of workstations, specifically work transfer station a and wash tanks 2-1 through 2-4. After the workpieces have been deposited at wash tank 2-4, workpiece transfer device 10-3 picks up the workpiece in the manner as previously described and moves them transversely to the acid treatment tank B where the cylinder bores are subjected to an acid bath treatment of the interior surfaces thereof with the ports of the workpieces sealed in the manner as described in connection with FIG. 4. Workpiece transfer device 10-3 then picks up the workpieces and moves them back to the main line for continued longitudinal movement along the washtanks 3-1 through 3-4. This process of longitudinal and transverse movement along the workstations is continued until the workpieces eventually reaches the drying station e from where they are moved to the removal station 3.

As previously described, at workstation D, the bore surfaces of each workpiece are subjected to an electroplating solution (for example, chrome plating solution) with the ports sealed as shown in FIG. 4. Following the electroplating treatment, residual solution will be blown from the interior of the workpiece before the workpiece is returned to the main line. This prevents drippage of plating solution on the workstation equipment, including the transfer station d.

Of course, it is to be noted that in actual practice, all of the workpiece transfer devices 10-1 through 10-6 simultaneously handle four engine cylinders on a pair of jigs 13. Thus, the system enables very rapid and highly efficient processing and treatment of workpieces in a high volume operation. Moreover, since the workstations A, B, C and D are all located outside the main treatment line, the total length of the main treatment line may be shortened by the length that each workstation A–D exceeds the standard length of the successive workstations in the main line. The total length of the main line is therefore held substantially to the total length of the workstations in the main line, with lengths $L_1$ through $L_6$ between workstations A–D held equal to simplify control of the work transfer system. While variations in the distance between individual workstations can be accommodated with high speed automated equipment, it is to be noted that in the preferred embodiment, the distance $L_1$ between the degreasing station 1 and the work transfer station a is equal to the distance $L_2$ between work transfer station a and work transfer station b. This is also the distance between the transversely located treatment station A and B. This same length equivalency occurs between workstations B, C and D as shown by lengths $L_3$ and $L_4$. Likewise, the distance $L_5$ between work transfer station d and drying station e equivalent to the lengths L1 through L4. Accordingly, incremental movement of the workpieces W between the various workstations is simplified and the total length of the row of treating stations is minimized, despite the fact that workstations A through D may be longer in overall length than the individual workstations in the main line. The airblower system provides the advantage that residual chemical treating solution on the workpieces is effectively removed before the workpieces are returned to the main line which mostly consists of the degreaser and washing tanks, as well as work transfer stations.

The invention has been described in the context of a specific embodiment constituting a chrome plating and processing line for engine cylinder workpieces. However, the invention is not solely limited to the described embodiment, and has application to any type of workpiece as well as any type of chemical treating system using multiple workstations normally disposed in a row for sequential treatment of a workpiece. Even though the invention description and the illustrations describe a linear row of workstations, it is to be understood that such a "row" could be a curved or even a circular array of workstations constituting the main line. The transversely located stations having longer unit lengths than the main line workstations may be located anywhere transversely of the main line, including laterally, vertically or at intermediate locations between lateral and vertical with respect to the main line workstations. The workpiece transfer devices 10-1 through 10-6 could be oriented and arranged such that workpieces can be moved longitudinally along the main line as well as laterally or vertically with respect to the main line to move the workpieces into the transversely located workstations A–D. Moreover, the ports in the workpiece could have any configuration and likewise any appropriate sealing arrangement for the ports that would be evident to a person skilled in the art utilizing the principles described herein could be used. The actuator motors preferably are pneumatically driven, but it is to be understood that they also could be driven by any other fluid or even electrically energized. Although the workpieces are shown in a particular orientation relative to the individual workstations, it is to be understood that they could be oriented in any manner relative to the workstations that would be suggested by the configuration of the workpiece and the specific configuration of the individual workstations. Accordingly, the invention is not to be interpreted as limited to the specific embodiment described but rather by the scope of the appended claims.

What is claimed is:

1. A chemical treating system comprising:

a longitudinal row of adjacent chemical treating workstations;

longitudinal work transfer means for moving workpieces at least along the row between the workstations;

at least one additional chemical treating workstation located adjacent and transversely of the row of workstations;

transverse work transfer means for moving workpieces transversely between the row of workstations and the additional chemical treating workstation;

said longitudinal and transverse work transfer means arranged to move each workpiece to each chemical treating workstation sequentially;

said workstations in the row are spaced apart at substantially equal longitudinal increments, and the longitudinal position of the addition chemical treating workstation being also disposed at such longitudinal increment relative to workstations in the row on either longitudinal side of such additional chemical treating workstation position; and the total length of the additional chemical treating workstation including its associated equipment being greater than the length of at least the next lengthwise adjacent workstation in the row.

2. A chemical treating system as claimed in claim 1 wherein at least one of the workstations in the row is a work transfer station located at the position along the row of workstations corresponding to the longitudinal position of the additional chemical treating workstation, and wherein all of the workstations except the work transfer station includes liquid chemical treating means for contacting the workpiece with liquid substance; and wherein said transverse work transfer means is arranged to traverse the distance between said row of work transfer stations and said additional chemical treating workstation.

3. The chemical treating system as claimed in claim 2, wherein said chemical treating system is a high speed electrolytic metal plating system, and said workstations includes alkali bath, acid etching, anodizing and electrolytic plating workstations, wherein at least one of the last recited workstations constitutes said additional chemical treating workstation.

4. The chemical treating system as claimed in claim 2, wherein said chemical treating system is a high speed electrolytic metal plating system, and said workstations include alkali bath, acid etching, anodizing and electrolytic plating workstations, wherein all of the last recited workstations constitutes a plurality of additional chemical treating workstations disposed adjacent and transversely of the row of workstations.

5. A chemical treating system as claimed in claim 1, wherein said chemical treating system comprises an electrolytic plating system for plating the surfaces of interior chambers of workpieces having exterior openings in communication with the chambers, and wherein said additional chemical treating workstations include movable closure means for closing exterior openings in a workpiece during a liquid chemical treating operation, and means for actuating the closure means between sealing and unsealing positions.

6. A chemical treating system as claimed in claim 5, including means for varying the geometric arrangement of the movable closure means to accommodate various workpiece opening arrangements.

7. A chemical treating system as claimed in claim 6, wherein said actuating means includes linear fluid actuators; said closure means comprise fluid actuator driven plug elements for engaging workpiece openings; and said means for varying the geometric configuration of the closure means comprises different assemblies of actuators and closure plugs supported in different configurations and arranged so as to be interchangeable; and means for mounting the different assemblies to the additional chemical treating workstation.

8. The chemical treating system as claimed in claim 1, wherein said longitudinal work transfer means and said transverse work transfer means comprise a single transfer assembly.

9. A chemical treating system as claimed in claim 8, wherein said transfer assembly includes means for moving a workpiece to each workstation along the row of workstations in advance of the additional chemical treating workstation, then transversely to the additional chemical treating workstation, then transversely back to the next following workstation in the row of workstations, then longitudinally to the next workstation in the row.

10. A chemical treating system as claimed in claim 1, wherein at least said additional chemical treating workstation comprises means for subjecting a workpiece to a liquid chemical solution and means for removing residual solution from the workpiece following a treatment operation but before a treated workpiece is moved from the additional chemical treating workstation.

11. A chemical treating system as claimed in claim 10, wherein the removing means comprises an air blower.

12. A chemical treating system as claimed in claim 1, wherein said chemical treating system comprises an electrolytic plating system; said additional chemical treating workstation comprises a conductive conduit for conveying plating solution to the workpiece; and means for electrically charging the conduit.

13. A chemical treating system comprising a longitudinal row of adjacent chemical treating workstations spaced equidistant from one another, said workstations including workpiece transfer stations;

additional chemical treatment workstations located adjacent and transversely of the row of workstations, said additional chemical treatment workstations located transversely opposed to said workpiece transfer stations;

workpiece transfer means for sequentially moving workpieces longitudinally along the row of workstations, transversely of the row of workstations to the additional workstations, back to the row of workstations and along the row of workstations for continuous chemical treatment;

said workstations of said row having substantially equal overall length dimensions and said additional chemical treatment workstation having greater overall length dimensions than the workstations in said row.

14. A chemical treating system as claimed in claim 13, said workpiece transfer means comprising multiple longitudinally spaced longitudinal and transverse workpiece movers, each mover arranged to move an individual workpiece sequentially longitudinally along the row and at least up to the position along the row that is opposite at least one additional chemical treatment station.

15. A chemical treating system as claimed in claim 13 or 14, said additional chemical treatment station including liquid chemical treating means for subjecting a workpiece to a liquid chemical solution, and an air-blower means for removing residual chemical solution from a workpiece following a chemical treatment operation.

16. A chemical treating system as claimed in claim 13 or 14, wherein one of said additional chemical treatment workstations includes means for electrolytically chemically plating a metal workpiece surface, said chemical plating means including a conductive conduit for conveying electroplating solution to the workpiece surface, and means for electrically energizing the conduit during a workpiece plating operation.

17. A chemical treating system as claimed in claim 13, wherein at least one of the additional treatment workstations is adapted to contact interior workpiece surfaces defining at least one chamber including exterior ports with a liquid chemical treating solution;

at least one set of movable plug means located at said one additional workstation for engaging and plugging the ports of a workpiece during chemical treatment of the chamber surfaces at said one additional chemical treatment workstation; and actuating means for moving the set of plug means into engagement with workpiece ports.

18. A chemical treating system as claimed in claim 17, including plural sets of plug means having different configurations to accommodate various port configurations of different workpieces; and separate support means for each set of plug means interchangeably mountable to said one additional workstation.

19. A process for chemically treating surfaces of workpieces comprising:

moving workpieces sequentially and longitudinally along a row of equally longitudinally spaced chemical treating workstations;

interrupting the longitudinal movement of the workpieces and moving the workpieces transversely of the row of workstations for additional chemical processing at at least one additional chemical treatment workstation located transversely adjacent the row of workstations and disposed at an equal increment of distance between adjacent workstations in said row;

returning the workpiece to the row of workstations and continuing to move the workpiece along the row for continued chemical treatment;

each workstation arranged to carry out a single step in multi-step chemical treatment process for the workpiece surfaces; and said additional processing including using processing apparatus that elongates said at least one chemical treating workstation to a total length greater than the length of at least the next lengthwise adjacent workstation in said row.

20. A process for chemically treating workpieces as claimed in claim 19, wherein the additional chemical processing includes use of a liquid substance and wherein the workpieces include open ports to be sealed during treatment, including the step of sealing the ports using remotely controlled movable plugs driven by longitudinally oriented linear fluid motors at the additional chemical treatment workstation.

21. A process for chemically treating surfaces of workpieces as claimed in claim 19, including subjecting workpiece surfaces to liquid chemical treatment solution at least at the additional chemical treatment workstation, and airblowing residual solution form the workpiece surfaces before transferring the workpieces back to the row of workstations.

22. A process for chemically treating surfaces of workpieces as claimed in claim 19, wherein the chemical treatment carried out at said at least one additional chemical treatment workstations is an electroplating process using liquid electroplating solution conveyed by an electrically conductive electroplating solution supply conduit, including the step of electrically charging the conduit during the electrolytic plating process and using the conduit as an electrode to transmit electrical energy to the electroplating solution during the electroplating process.

* * * * *